US010160216B2

(12) United States Patent
Nakai et al.

(10) Patent No.: US 10,160,216 B2
(45) Date of Patent: Dec. 25, 2018

(54) DROPLET DISCHARGE HEAD AND IMAGE FORMING APPARATUS INCORPORATING SAME

(71) Applicants: Takayuki Nakai, Kanagawa (JP); Takahiro Yoshida, Ibaraki (JP); Shiomi Andou, Kanagawa (JP); Toshimichi Odaka, Kanagawa (JP); Kanshi Abe, Ibaraki (JP)

(72) Inventors: Takayuki Nakai, Kanagawa (JP); Takahiro Yoshida, Ibaraki (JP); Shiomi Andou, Kanagawa (JP); Toshimichi Odaka, Kanagawa (JP); Kanshi Abe, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 8 days.

(21) Appl. No.: 15/333,389

(22) Filed: Oct. 25, 2016

(65) Prior Publication Data

US 2017/0120602 A1 May 4, 2017

(30) Foreign Application Priority Data

Nov. 4, 2015 (JP) ..... 2015-216696
Dec. 10, 2015 (JP) ..... 2015-241564

(51) Int. Cl.
*B41J 2/175* (2006.01)
*B41J 2/18* (2006.01)
(Continued)

(52) U.S. Cl.
CPC ..... *B41J 2/175* (2013.01); *B41J 2/14233* (2013.01); *B41J 2202/12* (2013.01)

(58) Field of Classification Search
CPC ..... B41J 2/175; B41J 2/14032; B41J 2/1433; B41J 2/165; B41J 2/18; B41J 2/19;
(Continued)

(56) References Cited

U.S. PATENT DOCUMENTS

2011/0228012 A1* 9/2011 Yoshida ..... B41J 2/14274 347/68
2011/0234705 A1* 9/2011 Fukada ..... B41J 2/14274 347/68

(Continued)

FOREIGN PATENT DOCUMENTS

JP 2014-210373 11/2014
JP 2015-071289 4/2015

*Primary Examiner* — Alessandro Amari
*Assistant Examiner* — Scott A Richmond
(74) *Attorney, Agent, or Firm* — Cooper & Dunham LLP

(57) ABSTRACT

A droplet discharge head includes a plurality of discharge orifices, a plurality of pressure generation chambers, a supply liquid chamber, a plurality of supply channels, a circulation liquid chamber, and a plurality of circulation channels. The discharge orifices discharge droplets. The pressure generation chambers are communicated with the discharge orifices, to apply pressure to liquid in the pressure generation chambers. The supply liquid chamber stores liquid to be supplied to the pressure generation chambers. The supply channels are communicated with the pressure generation chambers. The circulation liquid chamber receives liquid collected from the pressure generation chambers. The circulation channels communicate the pressure generation chambers with the circulation liquid chamber. Each of the circulation channels includes a small cross-section portion that has a smaller cross-sectional area in a width direction perpendicular to a longitudinal direction of each of the circulation channels than another portion in the longitudinal direction.

6 Claims, 10 Drawing Sheets

(51) Int. Cl.
*B41J 2/19* (2006.01)
*B41J 2/14* (2006.01)

(58) Field of Classification Search
CPC ..... B41J 2202/07; B41J 2202/12; B41J 2002/14338; B41J 2002/16502; B41J 2002/14467
See application file for complete search history.

(56) References Cited

U.S. PATENT DOCUMENTS

| | | | | |
|---|---|---|---|---|
| 2011/0234706 | A1* | 9/2011 | Yoshida | B41J 2/14274 347/68 |
| 2012/0176450 | A1* | 7/2012 | Akahane | B41J 2/14233 347/47 |
| 2012/0182352 | A1* | 7/2012 | Fukada | B41J 2/14274 347/54 |
| 2015/0062255 | A1 | 3/2015 | Sasaki | |
| 2016/0082728 | A1 | 3/2016 | Kohda et al. | |
| 2016/0096369 | A1 | 4/2016 | Shimizu et al. | |
| 2016/0185113 | A1 | 6/2016 | Yoshida et al. | |

* cited by examiner

DROPLET DISCHARGE HEAD AND IMAGE FORMING APPARATUS INCORPORATING SAME

CROSS-REFERENCE TO RELATED APPLICATIONS

This patent application is based on and claims priority pursuant to 35 U.S.C. § 119(a) to Japanese Patent Application Nos. 2015-216696 filed on Nov. 4, 2015, and 2015-241.564 filed on Dec. 10, 2015 in the Japan Patent Office, the entire disclosure of which is hereby incorporated by reference herein.

BACKGROUND

Technical Field

Aspects of the present disclosure relate to a droplet discharge head to discharge droplets from a plurality of discharge orifices and an image forming apparatus including the droplet discharge head to form an image.

Related Art

A droplet discharge head includes a plurality of pressure generation chambers, a supply liquid chamber to store liquid to be supplied to the plurality of pressure generation chambers, and a circulation liquid chamber to receive liquid collected from the plurality of pressure generation chambers.

SUMMARY

In an aspect of the present disclosure, there is provided a droplet discharge head that includes a plurality of discharge orifices, a plurality of pressure generation chambers, a supply liquid chamber, a plurality of supply channels, a circulation liquid chamber, and a plurality of circulation channels. The plurality of discharge orifices discharges droplets. The plurality of pressure generation chambers is communicated with the plurality of discharge orifices, to apply pressure to liquid in the plurality of pressure generation chambers. The supply liquid chamber stores liquid to be supplied to the plurality of pressure generation chambers. The plurality of supply channels is communicated with the plurality of pressure generation chambers. The circulation liquid chamber receives liquid collected from the plurality of pressure generation chambers. The plurality of circulation channels communicates the plurality of pressure generation chambers with the circulation liquid chamber. Each of the plurality of circulation channels includes a small cross-section portion that has a smaller cross-sectional area in a width direction perpendicular to a longitudinal direction of each of the plurality of circulation channels than another portion in the longitudinal direction of each of the plurality of circulation channels.

In another aspect of the present disclosure, there is provided an image forming apparatus that includes the droplet discharge head, a sheet conveyor, and a carriage. The droplet discharge head discharges droplets from the plurality of discharge orifice to record an image on a recording sheet. The sheet conveyor conveys the recording sheet in a first direction. The carriage is mounted with the droplet discharge head, to move the droplet discharge head along a surface of the recording sheet in a second direction perpendicular to the first direction.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
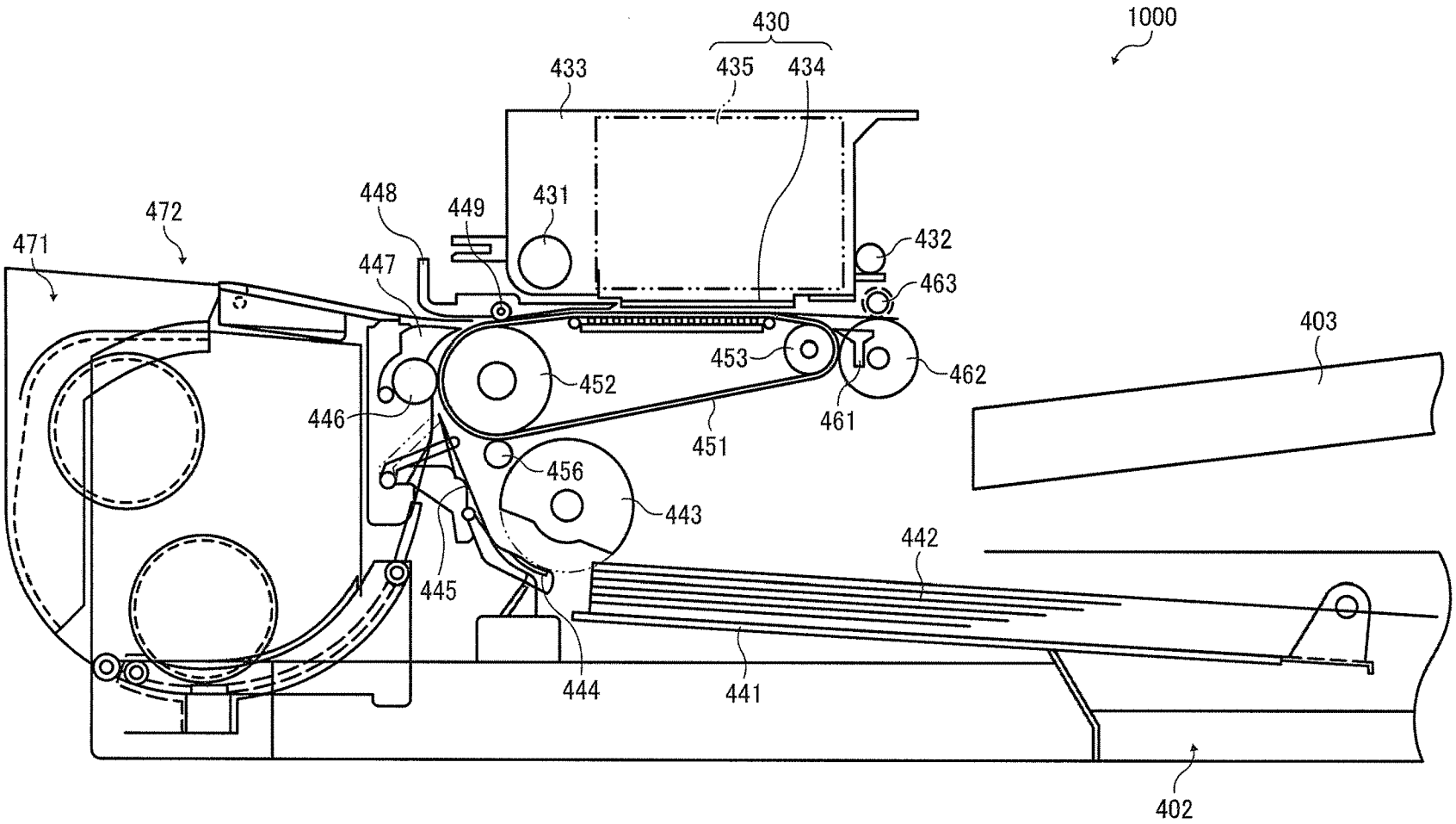
FIG. 1 is a schematic view of a configuration of a portion of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

An image forming apparatus according to an embodiment of the present disclosure is described below. Note that the term "recording sheet" is not limited to sheet of paper but represents a material to which ink droplets or other liquid can adhere. For example, a recording sheet may be an overhead projector (OHP) sheet, fabric, glass, or a substrate, and be used as a synonym of a recorded medium, a recording medium, a recording paper, or a recording sheet of paper. The terms "image formation", "recording", "printing", and "image printing" are used herein as synonyms for one another.

The term "image forming apparatus" is an apparatus to form an image by discharging liquid onto a medium made of, for example, paper, thread, fiber, fabric, leather, metals, plastics, glass, wood, or ceramics. The term "image formation" includes aspects of providing not only meaningful images, such as characters and figures but meaningless images, such as patterns, to a recording medium (the term "image formation" includes aspects of causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on. The term "liquid" used in the image forming apparatus is not limited to a recording liquid or ink but represents any material that is a fluid when discharged. The term "droplet discharge apparatus" is an apparatus to discharge liquid from a droplet discharge head and represents any apparatus that is referred to as a recording apparatus, a printing apparatus, an image forming apparatus, a droplet discharge apparatus, a liquid discharge apparatus, a treatment liquid coating apparatus, or a three-dimensional fabricating apparatus. The term "droplet discharge apparatus" is not limited to an apparatus to form an image.

The term "image" used herein is not limited to a two-dimensional image and includes, for example, an image applied to a three dimensional object and a three dimensional object itself formed as a three-dimensionally molded image.

The term "image forming apparatus", unless specified, also includes both serial-type image forming apparatus and line-type image forming apparatus. The serial-type image forming apparatus is an apparatus to perform recording by moving a droplet discharge head mounted on a carriage in a main scanning direction perpendicular to a sheet feed direction. The line-type image forming apparatus is an apparatus that uses a line-type head that includes a plurality of discharge ports (nozzles) arranged in rows to discharge droplets across substantially the entire width of a recording area. In the present embodiment, an example of the serial-type image forming apparatus is described below. However, the image forming apparatus is not limited to the serial-type image forming apparatus.

Droplet discharge heads are broadly classified into some types, according to the types of actuators to discharge ink droplets (recording liquid). For example, for a piezo-type droplet discharge head, a thin diaphragm constitutes a portion of a wall of a liquid chamber, and a piezoelectric element as an electromechanical transducer element is disposed corresponding to the diaphragm. By deforming the diaphragm by deformation of the piezoelectric element generated with the application of voltage, the pressure in a pressure generation chamber is changed to discharge ink droplets. Further, for a bubble jet (registered trademark) type droplet discharge head, a heat generating element is disposed in a liquid chamber. Heating of a heat generator by energization generates bubbles to discharge ink droplets by the pressure of bobbles. For an electrostatic-type droplet discharge head, a diaphragm constitutes a wall of a liquid chamber, and a discrete electrode is disposed opposite the diaphragm outside the liquid chamber. By forming an electric field between the diaphragm and the discrete electrode, the diaphragm, is deformed to change the internal pressure and volume of the liquid chamber, thus discharging ink droplets from a nozzle. In the present embodiment, an example of the piezo-type droplet discharge head is described below. However, the droplet discharge head is not limited to the piezo-type droplet discharge head.

Figure 2:
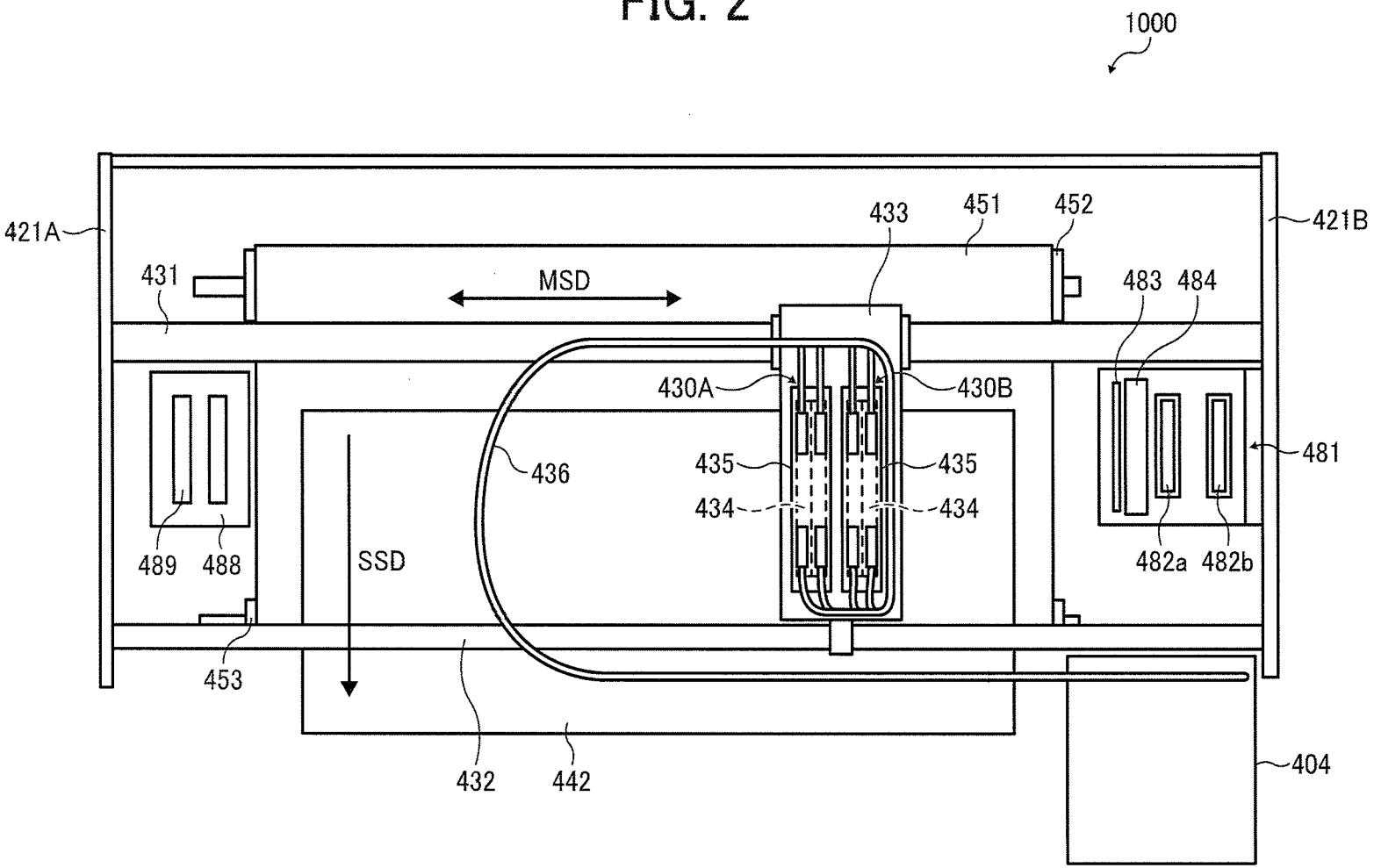
FIG. 2 is a plan view of the image forming apparatus of FIG. 1.

First, a configuration of an image forming apparatus according to an embodiment of the present disclosure is described below. FIG. 1 is a schematic view of a configuration of a portion of an image forming apparatus according to an embodiment of the present disclosure. FIG. 2 is a plan view of the image forming apparatus of FIG. 1.

An image forming apparatus 1000 according to the present embodiment is a serial-type inkjet recording apparatus. A carriage 433 is supported by a main guide rod 431 and a sub guide rod 432 so as to be reciprocally movable in a direction (main scanning direction) indicated by arrow MSD in FIG. 2. The main guide rod 431 and the sub guide rod 432 are laterally bridged between a left side plate 421A and a right side plate 421B. The carriage 433 is mounted with two droplet discharge units 430A and 430B (also collectively referred to as droplet discharge units 430 unless distinguished) to hold droplet discharge heads 434 as droplet discharge members. The droplet discharge heads 434 include nozzle rows, each including a plurality of nozzles (discharge orifices) arrayed in row in a sub-scanning direction (the longitudinal direction of the droplet discharge head 434), which is indicated by arrow SSD in FIG. 2, perpendicular to the main scanning direction MSD. The droplet discharge heads 434 are mounted to the carriage 433 so that ink droplets are discharged downward.

Each of the droplet discharge units 430A and 430B includes two nozzle rows. The droplet discharge head 434 of the droplet discharge unit 430A discharges ink droplets of black (K) from nozzles of one of the two nozzle rows and ink droplets of cyan (C) from nozzles of the other of the two nozzle rows. The droplet discharge head 434 of the droplet discharge unit 430B discharges ink droplets of magenta (M) from nozzles of one of the two nozzle rows and ink droplets of yellow (Y) from nozzles of the other of the two nozzle rows.

As described above, the image forming apparatus 1000 according to the present embodiment uses the two droplet discharge heads to discharge ink droplets of four colors. However, in some embodiments, a single droplet discharge head may include four nozzle rows to discharge ink droplets of four colors.

A supply circulation assembly 404 is mounted to an apparatus body side. A supply tank 413 and a circulation tank 415 are disposed in the supply circulation assembly 404. Ink flows from the supply tank 413 and the circulation tank 415 to the droplet discharge head 434 on the carriage 433 through a tube bundle 436.

The image forming apparatus 1000 according to the present embodiment includes a sheet feeder to feed recording sheets 442 as recording media stacked on a sheet stack 441 of a sheet feed tray 402. The sheet feeder includes, for example, a sheet feed roller 443 and a separation pad 444 disposed opposite the sheet feed roller 443. The sheet feed roller 443 and the separation pad 444 separate and feed the recording sheets 442 one by one from the sheet stack 441.

The image forming apparatus 1000 according to the present embodiment further includes a guide 445, a counter roller 446, a conveyance guide 447, and a pressing member 448 including a leading-end pressing roller 449, to convey and guide the recording sheet 442 fed by the sheet feeder. The image forming apparatus 1000 further includes a conveyance belt 451 as a sheet conveyor to attract the recording sheet 442 and convey the recording sheet 442 at a position opposite the droplet discharge heads 434 of the droplet discharge units 430.

The conveyance belt 451 is an endless belt looped around a conveyance roller 452 and a tension roller 453 to circulate in a belt conveyance direction (sub-scanning direction) indicated by arrow SSD in FIG. 2. The conveyance belt 451 is an electrostatic conveyance belt charged by a charging roller 456 as a charger. However, in some embodiments, the conveyance belt 451 may be a conveyance belt to attract the recording sheet 442 by air suction. Alternatively, the conveyor is not limited to the conveyance belt and may be, for example, a conveyance roller.

On a downstream side of the tension roller 453 around which the conveyance belt 451 is looped, the image forming apparatus 1000 includes a separation claw 461, a sheet ejection roller 462, a sheet ejection roller 463, and a sheet ejection tray 403. The separation claw 461 separates the recording sheet 442 from the conveyance belt 451. The sheet ejection tray 403 is disposed below the sheet ejection roller 462. A duplex unit 471 is removably attached to a rear portion of the apparatus body. The duplex unit 471 takes in the recording sheet 442 returned by the reverse-directional rotation of the conveyance belt 451, reverses the recording sheet 442, and feeds the recording sheet 442 between the counter roller 446 and the conveyance belt 451 again. A bypass tray 472 is disposed at an upper face of the duplex unit 471. A maintenance device (maintenance-and-recovery device) 481 is disposed in a non-printing area (non-recording area) at one end in the main scanning direction MSD of the carriage 433. The maintenance device 481 maintains and recovers nozzle conditions of the droplet discharge heads 434 of the droplet discharge units 430A and 430B.

The maintenance device 481 includes caps 482*a* and 482*b* to cap the nozzle faces of the droplet discharge heads 434. The maintenance device 481 also includes a blade 483 to wipe the nozzle faces. The maintenance device 481 further includes, e.g., a dummy discharge receptacle 484 to receive ink discharged in dummy discharge in which ink not contributing to image formation is discharged to discharge thickened ink. In the non-printing area at the other end in the main scanning direction MSD of the carriage 433, the image forming apparatus 1000 includes a dummy discharge receptacle 488 to receive ink discharged by dummy discharge during image formation. The dummy discharge receptacle 488 has mouths 489 extending along a nozzle array direction of the droplet discharge head 434 in which nozzles are arrayed in rows.

In the image forming apparatus 1000 according to the present embodiment, the recording sheets 442 are separated sheet by sheet from the sheet feed tray 402, fed in a substantially vertically upward direction, guided along the guide 445, and conveyed with the recording sheets 442 interposed between the conveyance belt 451 and the counter roller 446. The leading end of the recording sheet 442 is guided by the conveyance guide 447 and pressed against the conveyance belt 451 by the leading-end pressing roller 449. Accordingly, the direction of conveyance of the recording sheet 442 is turned substantially 90 angle degree. When the recording sheet 442 is fed onto the conveyance belt 451 charged by the charging roller 456, the recording sheet 442 is attracted onto the conveyance belt 451 and conveyed in the sub-scanning direction SSD by circulation of the conveyance belt 451. By driving the droplet discharge heads 434 of the droplet discharge units 430A and 430B in response to image signals while moving the carriage 433, ink is discharged onto the recording sheet 442 stopped, to record one line of a desired image. Then, the recording sheet 442 is fed by a predetermined distance, and another line is recorded. By receiving a recording end signal or a signal indicating that the trailing end of the recording sheet 442 has arrived at the recording area, the image forming apparatus 1000 terminates the recording operation and ejects the recording sheet 442 onto the sheet ejection tray 403.

Figure 3:
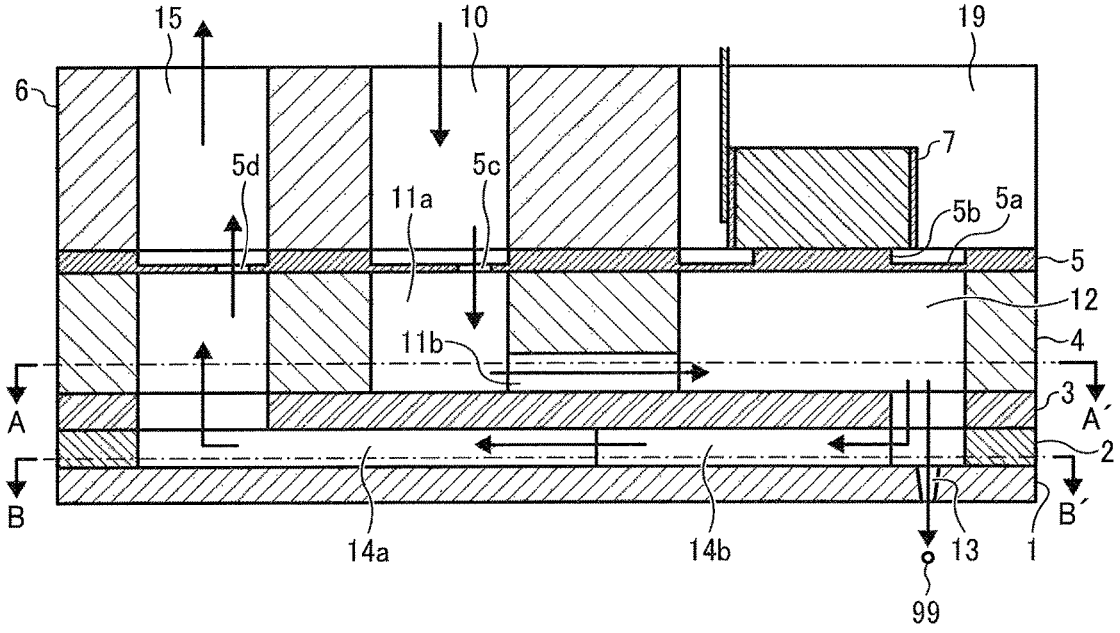
FIG. 3 is a cross-sectional side view of a droplet discharge head of the image forming apparatus of FIG. 1.
Figure 4:
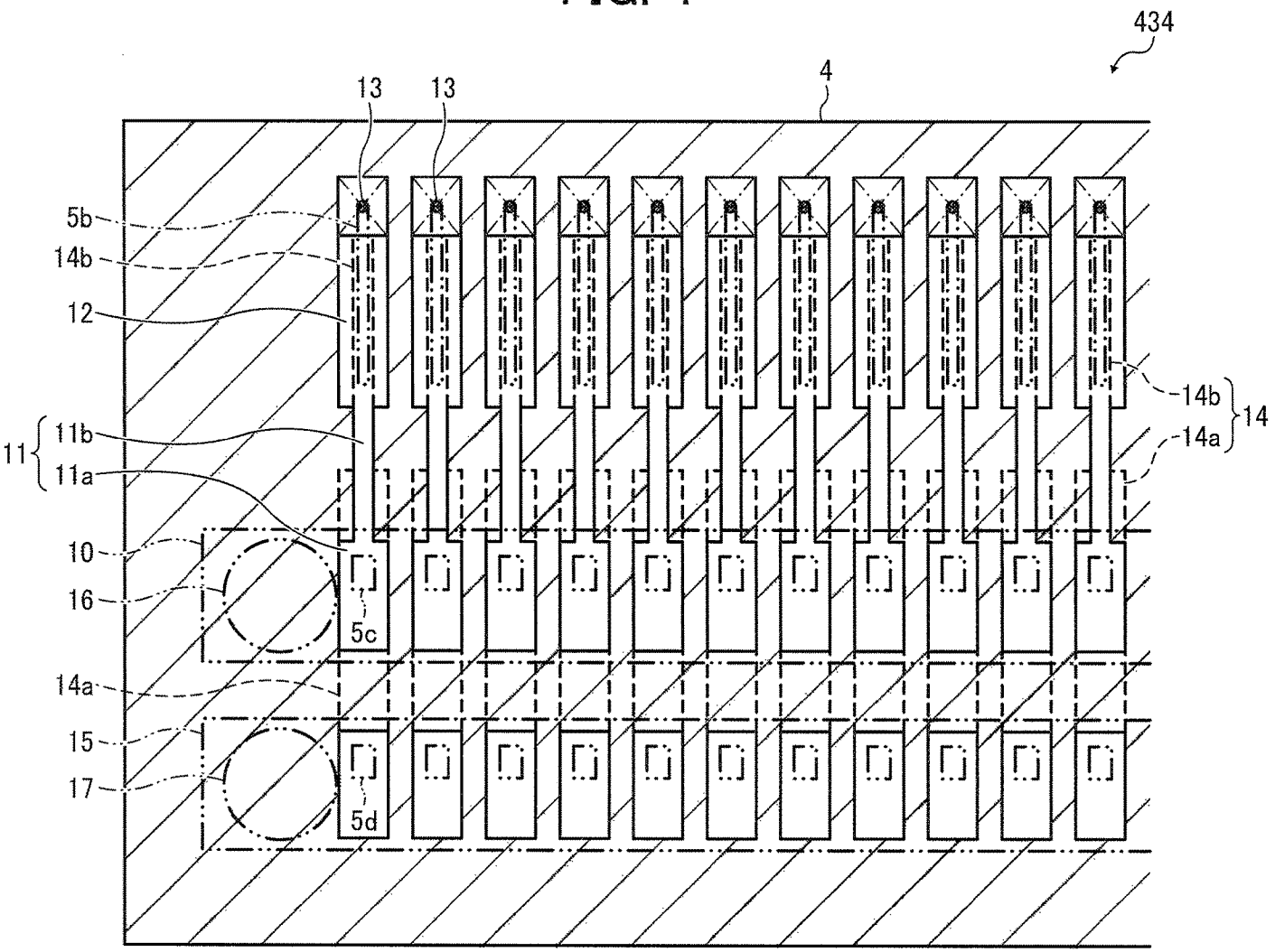
FIG. 4 is a cross-sectional plan view of the droplet discharge head cut along line A-A' of FIG. 3.
Figure 5:
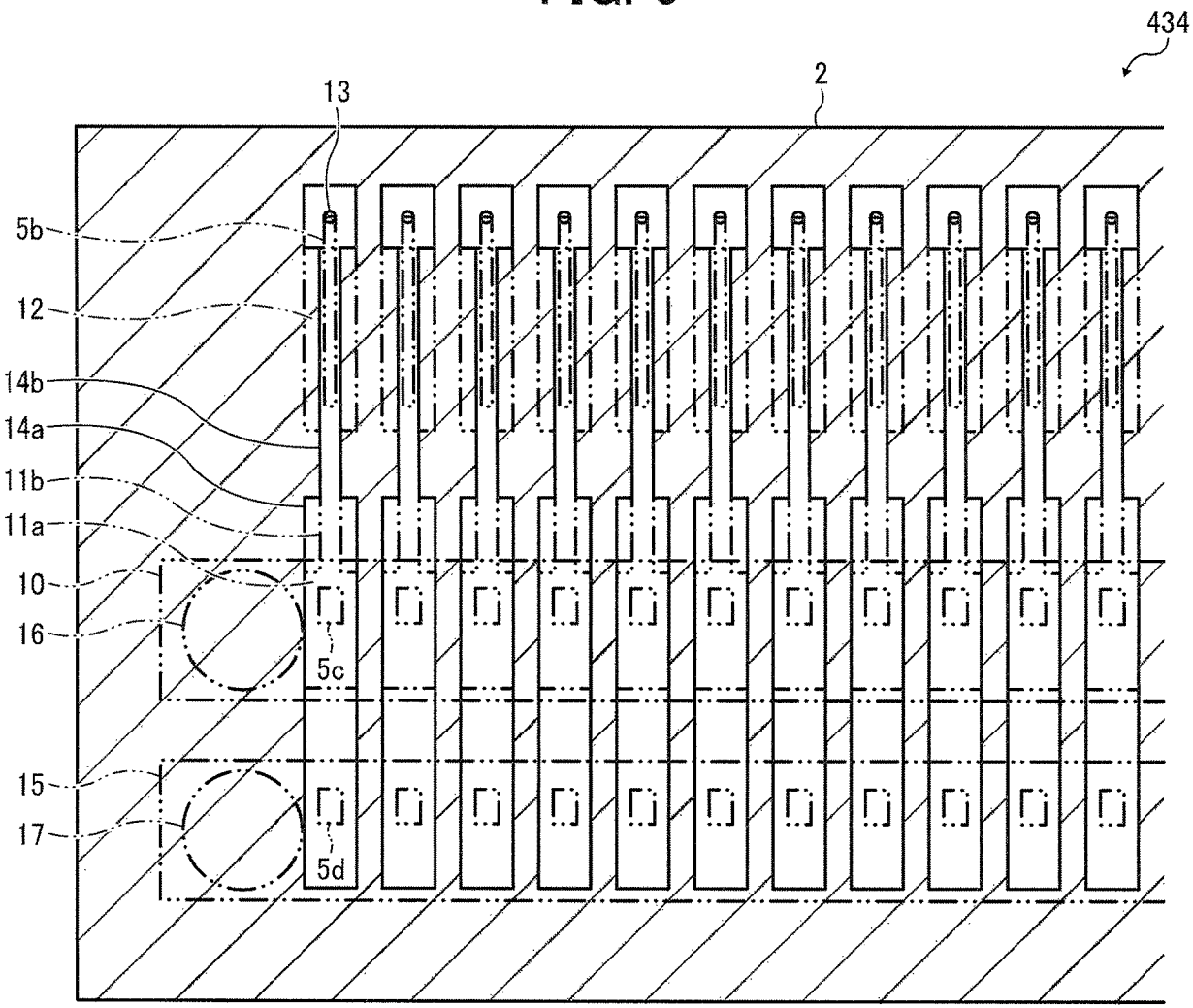
FIG. 5 is a cross-sectional plan view of the droplet discharge head cut along B-B' line of FIG. 3.

FIG. 3 is a cross-sectional side view of the droplet discharge head 434. FIG. 4 is a cross-sectional plan view of the droplet discharge head 434 cut along A-A' line of FIG. 3. FIG. 5 is a cross-sectional plan view of the droplet discharge head 434 cut along B-B' line of FIG. 3. In FIGS. 4 and 5, the outlines of components upper than the position of each cross section are indicated by chain double-dashed lines, and the outlines of components lower than the position of each cross section are indicated by broken lines.

In FIG. 3, the droplet discharge head 434 includes a base plate 1, a first plate 2, a second plate 3, a third plate 4, a fourth plate 5, and a fifth plate 6.

As illustrated in FIG. 4, the fifth plate 6 includes a supply liquid chamber 10, a circulation liquid chamber 15, and a piezoelectric-element mount portion 19, each of which is a slit extending in the longitudinal direction of the droplet discharge head 434.

In FIG. 3, the fourth plate 5, on which the fifth plate 6 is directly laminated, includes diaphragm portions 5*a* and vibration transmitting portions 5*b*. The diaphragm portions 5*a* are processed by half etching to be thin. The vibration transmitting portions 5*b* rise from the diaphragm portions 5*a*. As illustrated in FIG. 4, the vibration transmitting portions 5*b* has an elongated box shape and are arranged side by side such that the short direction of each vibration transmitting portion 5*b* is parallel to the longitudinal direction of the droplet discharge head 434. Laminated piezoelectric elements 7 are secured on the vibration transmitting portions 5*b*. The fifth plate 6 is made of two layers of Ni alloy plating films overlapped by electroforming.

In the present embodiment, the two laminated piezoelectric elements 7 are disposed along the longitudinal direction of the droplet discharge head 434. The laminated piezoelectric element 7 has a structure in which a piezoelectric layer made of lead zirconate titanate (PZT) of a thickness of 10 μm to 50 μm and an internal electrode layer made of silver-palladium (AgPd) are alternately laminated. Both ends of the internal electrode layer is connected to external electrodes. The laminated piezoelectric element 7 is divided by half-cut dicing to have a comb shape (hereinafter, referred to as divided elements), and the divided elements are bonded to the vibration transmitting portions 5*b* separately from each other to separately apply vibration to the vibration transmitting portions 5*b*. The outer side of the external electrodes is divided by half-cut dicing and the length of the external electrodes is limited by processing, e.g., notching to form a plurality of discrete electrodes. Separately applying voltage to the respective discrete electrodes allows the plurality of divided elements to vibrate separately from each other. The inner side of the external electrodes is not divided, and acts as a common electrode.

In FIG. 3, the second plate 3 is directly laminated on an upper face of the first plate 2, the third plate 4 is directly laminated on an upper face of the second plate 3, and the fourth plate 5 is directly laminated on an upper face of the third plate 4. Each of the first plate 2, the second plate 3, and the third plate 4 is made of stainless steel material. The first plate 2, the second plate 3, and the third plate 4 are laminated one on another to form a supply channel 11, a pressure generation chamber 12, and a circulation channel 14.

The supply channel 11 is formed with a slit and a half-etched portion (recessed portion) of the third plate 4. As illustrated in FIG. 4, the supply channel 11 includes a large cross-section portion 11*a* having a relatively large cross-sectional area in a width direction perpendicular to a longitudinal direction of the supply channel 11 and a small cross-section portion 11*b* having a relatively small cross-sectional area in the width direction. Of the slit and the half-etched portion, the large cross-section portion 11*a* is formed with the slit. The small cross-section portion 11*b* is formed with the half-etched portion.

In FIG. 3, the pressure generation chamber 12 is formed with slits in the third plate 4, the second plate 3, and the first plate 2, respectively, so that the pressure generation chamber 12 is communicated with the small cross-section portion 11*b* of the supply channel 11.

The circulation channel 14 is formed with slits in the first plate 2, the second plate 3, and the third plate 4, respectively. The slit of the first plate 2 is communicated with the pressure generation chamber 12. The slit of the second plate 3 is formed by pressing process to be communicated with the slit of the first plate 2. The slit of the third plate 4 is communicated with the slit of the second plate 3. As illustrated in FIG. 5, the circulation channel 14 includes a small cross-section portion 14*b* having a relatively small cross-sectional area in a width direction perpendicular to a longitudinal direction of the circulation channel 14 and a large cross-section portion 14*a* having a relatively large cross-sectional area in the width direction. The small cross-section portion 14*b* is formed with the slit of the first plate 2 and communicated with the large cross-section portion 14*a*.

As illustrated in FIG. 4, a plurality of sets of the supply channels 11 and the pressure generation chambers 12 communicated with the supply channels 11 is arranged in the longitudinal direction of the droplet discharge head 434. The vibration transmitting portions 5*b* are disposed on respective upper walls of the pressure generation chambers 12. Accordingly, the diaphragm portions 5*a* of the respective pressure generation chamber 12 can be separately vibrated to separately apply pressure to ink in the respective pressure generation chamber 12.

The plurality of circulation channels 14 is arranged in the longitudinal direction of the droplet discharge head 434 and communicated with corresponding ones of the plurality of pressure generation chambers separately from each other.

Note that the slit of the third plate 4 and the slit of the fifth plate 6 are formed by cutting process.

The first plate 2 is directly laminated on an upper face of the first plate 2. The base plate 1 made of stainless steel material includes a plurality of nozzles 13 communicated with the plurality of pressure generation chambers 12 separately from each other. The nozzle 13 has such a tapered shape that the ink-droplet discharge side is narrower than the ink introduction side. The diameter is approximately 20 μm to 35 μm. The arrangement pitch is 150 dpi.

The plurality of supply channels 11 illustrated in FIG. 4 is communicated with the single supply liquid chamber 10 extending in the longitudinal direction of the droplet discharge head 434. For example, as illustrated in FIG. 3, the plurality of supply channels 11 is communicated with the supply liquid chamber 10 via a plurality of supply ports 5*c*. The plurality of supply ports 5*c* is disposed corresponding to the respective supply channels 11 in the fourth plate 5.

The plurality of circulation channels 14 illustrated in FIG. 4 is communicated with the single circulation liquid chamber 15 extending in the longitudinal direction of the droplet discharge head 434. For example, as illustrated in FIG. 3, the plurality of circulation channels 14 is communicated with the circulation liquid chamber 15 via a plurality of collection ports 5*d*. The plurality of collection ports 5*d* is disposed corresponding to the respective circulation channels 14 in the fourth plate 5.

Figure 6:
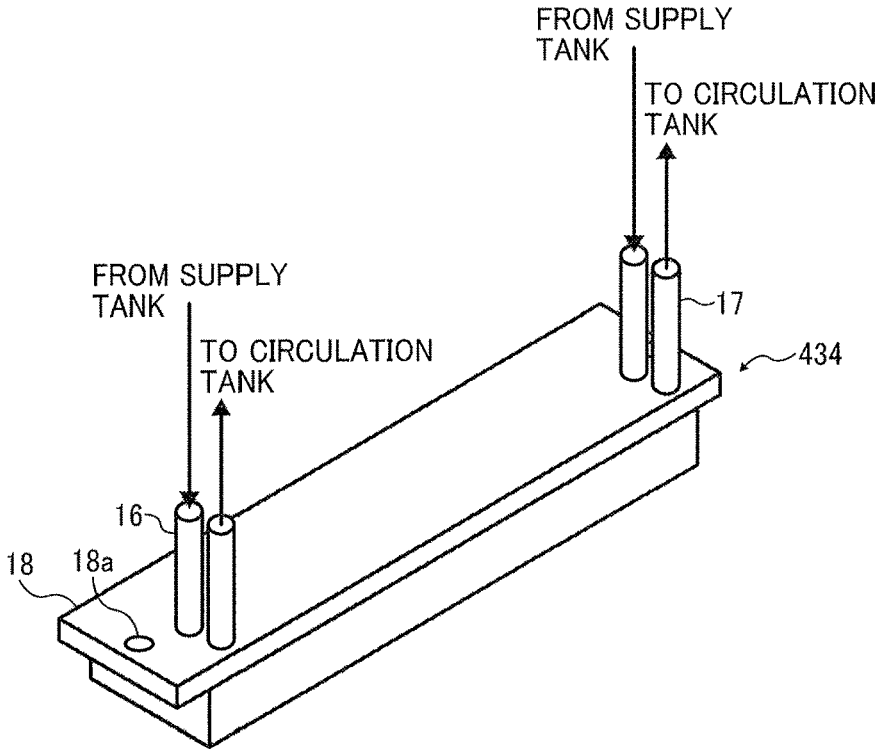
FIG. 6 is a perspective view of the droplet discharge head.

FIG. 6 is a perspective view of the droplet discharge head 434. The droplet discharge head 434 is mounted on the carriage 433 in such a posture that the plurality of nozzles 13 is oriented vertically downward. In FIG. 6, the droplet discharge head 434 has such a posture. The droplet discharge head 434 has a supply-side base 18 bonded on the fifth plate 6 illustrated in FIG. 3. In FIG. 6, the supply-side base 18 has screw holes 18*a* at both ends in the longitudinal direction. The supply-side base 18 are secured to the carriage 433 with screws screwed into the screw holes 18*a*.

The supply-side base 18 has ink supply holes and ink circulation holes besides the two screw holes 18*a*. The ink supply holes are disposed at ends of the supply-side base 18 and communicated with the supply liquid chamber 10 illustrated in FIG. 4. Supply tubes 16 are joined on the upper face of the supply-side base 18 so that the supply tubes 16 are communicated with the respective ink supply holes (see FIG. 3). The supply tubes 16 are communicated with the supply tank 413 via tubes of the tube bundle 436 and a supply-side pressure sensor 417 (illustrated in FIG. 12).

The ink circulation holes are disposed at both ends of the supply-side base 18 and communicated with the circulation liquid chamber 15 illustrated in FIG. 4. Circulation tubes 17 are joined on the upper face of the supply-side base 18 so that the circulation tubes 17 are communicated with the respective ink circulation holes (see FIG. 3). The circulation tubes 17 are communicated with the circulation tank 415 via tubes of the tube bundle 436 (see FIG. 2) and a circulation-side pressure sensor 418 (illustrated in FIG. 12).

When a drive voltage (pulse voltage of 10V to 50V) is applied to a discrete electrode of the laminated piezoelectric element 7, the divided element corresponding to the discrete electrode displaces in the lamination direction. Accordingly, the vibration transmitting portion 5*b* and the diaphragm portion 5*a* also displaces in the same direction. Thus, ink stored in the pressure generation chamber 12 corresponding to the discrete electrode is pressurized, and an ink droplet 99 is discharged from the nozzle 13 communicated with the pressure generation chamber 12. Then, when the divided element returns to the initial position, the pressure of ink in the pressure generation chamber 12 decreases. Further, the pressure of ink is turned to be a negative pressure by the inertia of ink flow and the decay of drive voltage. Accordingly, the process shifts from the ink discharge step to the ink filling step. At this time, ink is supplied from the supply tank 413 to the supply liquid chamber 10 via the supply-side pressure sensor 417, and ink in the supply liquid chamber 10 is filled into the pressure generation chamber 12 via the supply channel 11.

In the above-described ink discharge step, a portion of ink in the pressure generation chamber 12 enters the circulation channel 14 with bubbles from the pressure generation chamber 12. In addition, a portion of ink in the large cross-section portion 14*a* of the circulation channel 14 flows into the circulation liquid chamber 15 with bubbles from the large cross-section portion 14*a*. Ink in the circulation liquid chamber 15 is fed into the circulation tank 415 via the circulation tubes 17 and the circulation-side pressure sensor 418. Ink in the circulation tank 415 is supplied to the supply liquid chamber 10 via a first liquid feed pump 414, the supply tank 413, and the supply-side pressure sensor 417.

As illustrated in FIG. 4, besides the large cross-section portion 14*a*, the circulation channel 14 includes the small cross-section portion 14*b* having a smaller cross-sectional area in the width direction of the circulation channel 14 than the large cross-section portion 14*a*. With such a configuration, the small cross-section portion 14*b* applies resistance against ink entering from the pressure generation chamber 12 to the circulation channel 14 and restricts the amount of ink collected from the pressure generation chamber 12 into the circulation liquid chamber 15 via the circulation channel 14. Such a configuration prevents the shortage of the amount of ink droplets discharged from the nozzle 13 due to collection of ink from the pressure generation chamber 12 into the circulation liquid chamber 15.

Note that, when ink in the pressure generation chamber 12 is pressurized, ink is discharged as ink droplets from the nozzle 13, enters the circulation channel 14 from the pressure generation chamber 12, and returns from the pressure generation chamber 12 to the supply channel 11. Such return might cause a shortage of the discharge amount of droplets from the nozzle 13. Hence, for the image forming apparatus 1000 according to the present embodiment, the supply channel 11 also includes, besides the large cross-section portion 11*a*, the small cross-section portion 11*b* having a smaller cross-sectional area in the width direction of the supply channel 11 than the large cross-section portion 11*a*. With such a configuration, the small cross-section portion 11*b* applies resistance against ink entering from the pressure generation chamber 12 to the supply channel 11 and restricts the amount of ink returned from the pressure generation chamber 12 into the supply channel 11. Such a configuration can also reduce the shortage of the discharge amount of droplets discharged from the nozzle 13 due to the return of ink from the pressure generation chamber 12 into the supply channel 11.

The small cross-section portion 11*b* of the supply channel 11 and the small cross-section portion 14*b* of the circulation channel 14 can exert an advantageous effect of decaying residual pressure vibration after ink droplet discharge. However, in the ink filling step, resistance is applied to ink returning from the supply channel 11 or the circulation channel 14 to the pressure generation chamber 12 to hamper the flow of ink. Consequently, a longer time is taken until the pressure in the pressure generation chamber 12 returns to the initial state. Hence, in the present embodiment, a good balance between the decay of residual pressure and the filling time is achieved by adjusting the amount of resistance applied to ink by the small cross-section portion 11*b* of the supply channel 11 and the amount of resistance applied to ink by the small cross-section portion 14*b* of the circulation channel 14. Such a configuration can shorten the time taken for the shift to the ink-droplet discharge operation (drive cycle).

Next, examples of the image forming apparatus 1000 according to the present embodiment are described below. Note that the configuration of each of the examples of the image forming apparatus is the same as the above-described embodiment unless specified.

First Example

When the laminated piezoelectric element 7 is driven, the ratio of the amount of ink droplets discharged from the nozzle 13, the amount of ink returning from the pressure generation chamber 12 to the supply channel 11, and the amount of ink entering the circulation channel 14 from the pressure generation chamber 12 is determined by the ratio of channel resistance. For example, the above-described ratio of the amounts of ink is determined by the ratio of the channel resistance of the small cross-section portion 14*b* of the circulation channel 14, the channel resistance of the small cross-section portion 11*b* of the supply channel 11, and the channel resistance of the nozzles 13. The pressure applied to the meniscus of the nozzle 13 is determined by, e.g., the above-described ratio of channel resistance or the pressure ratio of positive pressure and negative pressure, based on the nozzle position. For the circulation-type droplet discharge head 434, the pressure ratio of positive pressure and negative pressure is preferably 1:1 in consideration of the easiness of pressure control. In such a case, the ratio of the channel resistance of the small cross-section portion 14*b* of the circulation channel 14 and the channel resistance of the small cross-section portion 11*b* of the supply channel 11 is also preferably 1:1.

Figure 7:
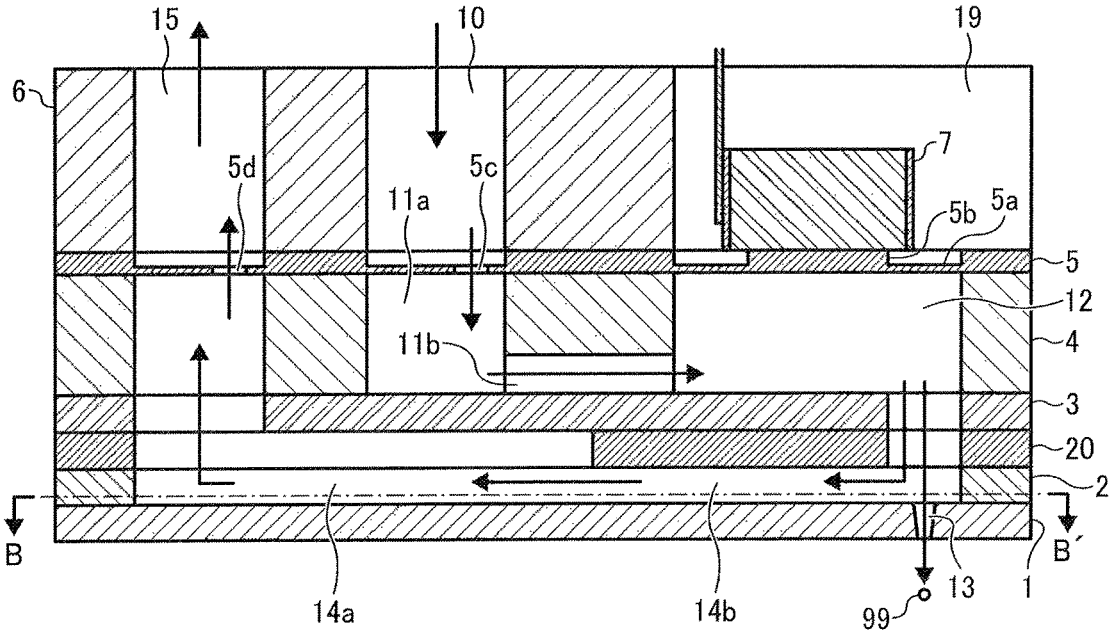
FIG. 7 is a cross-sectional side view of the droplet discharge head of the image forming apparatus according to a first example.
Figure 8:
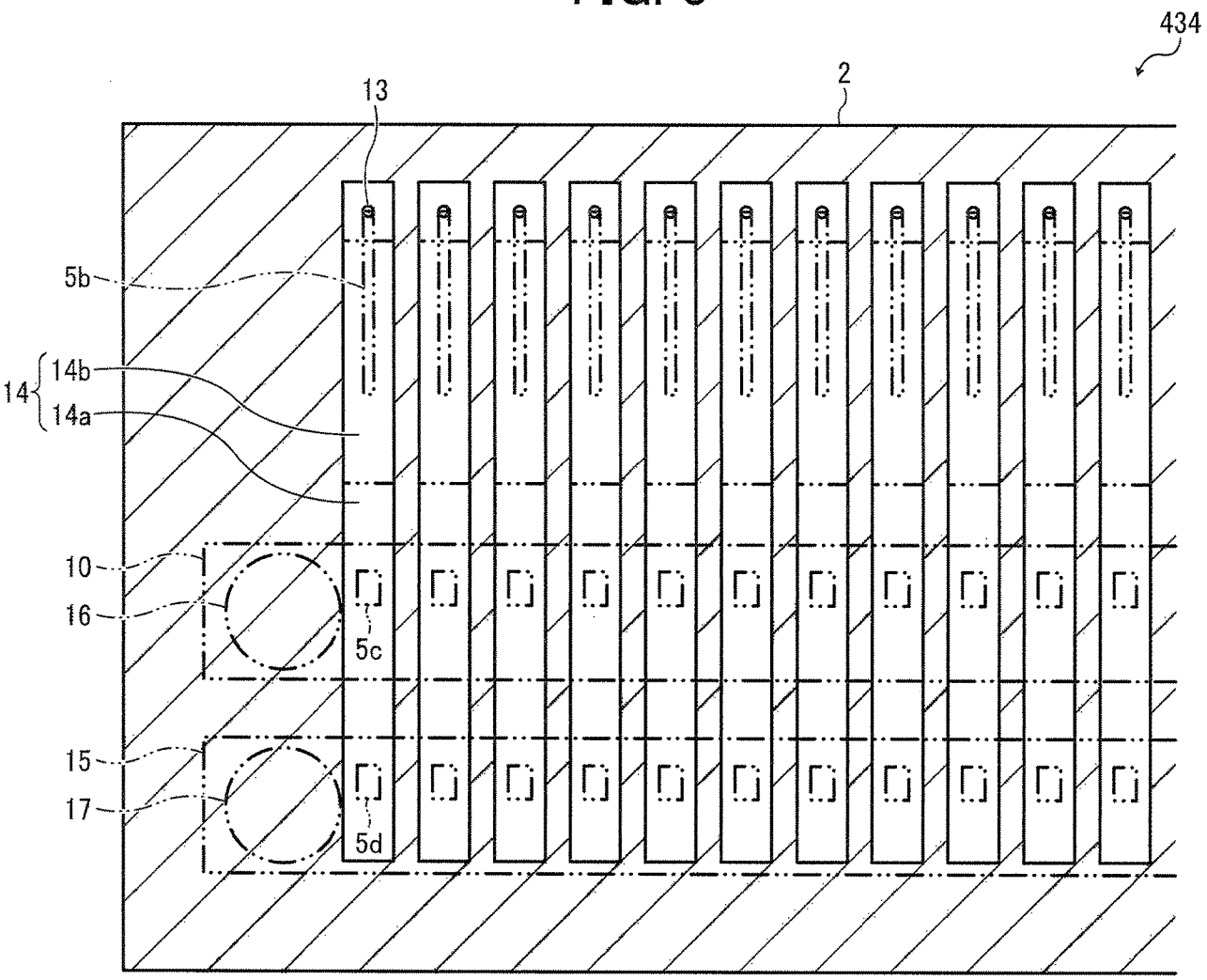
FIG. 8 is a cross-sectional plan view of the droplet discharge head cut along B-B' line of FIG. 7.

FIG. 7 is a cross-sectional side view of the droplet discharge head 434 of the image forming apparatus according to the first example. FIG. 8 is a cross-sectional plan view of the droplet discharge head 434 cut along B-B' line of FIG. 7. For the droplet discharge head 434 illustrated in FIG. 7, an intermediate plate 20 is interposed between the first plate 2 and the second plate 3. The intermediate plate 20 has a plurality of slits separately communicated with the plurality of pressure generation chambers 12 and a plurality of slits constituting part of the large cross-section portions 14*a* of the plurality of circulation channels 14.

As illustrated in FIG. 8, the large cross-section portion 14*a* and the small cross-section portion 14*b* of the circulation channel 14 have the same size in the width direction of the circulation channel 14. To make the cross-sectional area of the small cross-section portion 14*b* smaller than the cross-sectional area of the large cross-section portion 14*a* even with the same size in the width direction, as illustrated in FIG. 7, the depth of the small cross-section portion 14*b* is set to be smaller than the depth of the large cross-section portion 14*a*. An overlap region of the slit of the first plate 2 and the slit of the intermediate plate 20 acts as the large cross-section portion 14*a*. Another overlap region of the slit of the first plate 2 and a non-slit portion (plate portion) of the intermediate plate 20, which is shallower than the large cross-section portion 14*a*, acts as the small cross-section portion 14*b*.

For such a configuration, the size of the small cross-section portion 14*b* in the width direction is not smaller than the size of the large cross-section portion 14*a* in the width direction. Accordingly, the width of the slit of the first plate 2 for the small cross-section portion 14*b* can be set to the same width as the slit for the large cross-section portion 14*a*. Thus, as a method of making a hole in the first plate 2 to form the small cross-section portion 14*b*, a reasonable processing method not requiring high level of dimensional accuracy or low level of shock can be employed, thus allowing cost reduction. By adjusting the thickness of the first plate 2, the channel resistance of the small cross-section portion 14*b* can be easily adjusted, thus allowing the ratio of the channel resistance of the large cross-section portion 14*a* and the small cross-section portion 14*b* to be easily adjusted to 1:1.

Second Example

Similarly with the first example, for the image forming apparatus 1000 according to a second example, the large cross-section portion 14*a* and the small cross-section portion 14*b* of the circulation channel 14 have the same size in the width direction. The depth of the small cross-section portion 14*b* of the circulation channel 14 is smaller than the depth of the large cross-section portion 14*a*, and the small cross-section portion 14*b* has a smaller cross-sectional area in the width direction than the large cross-section portion 14*a*.

Figure 9:
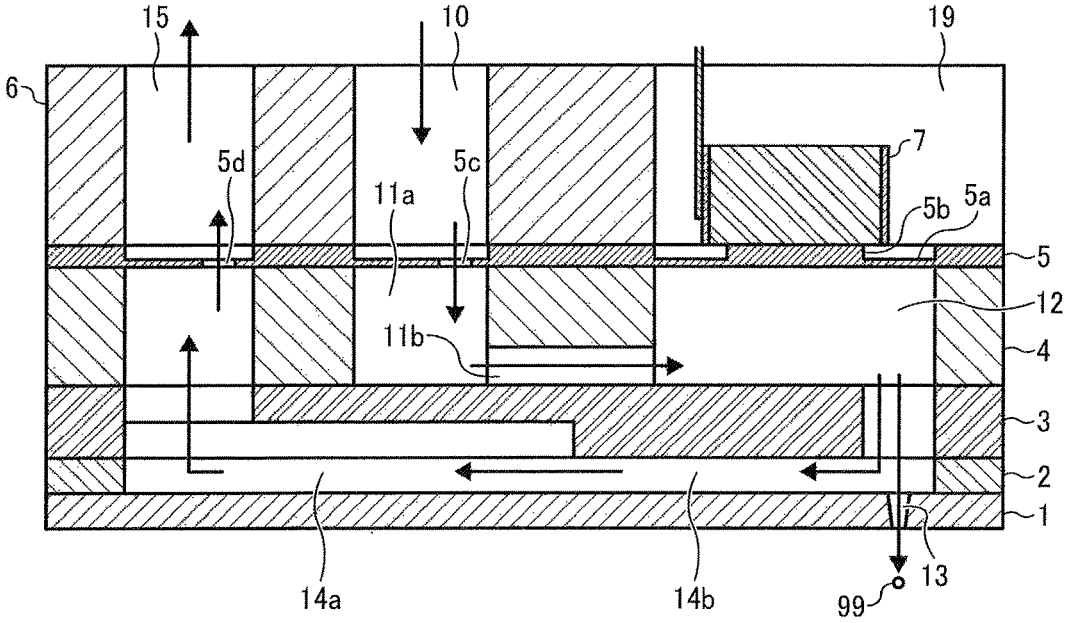
FIG. 9 is a cross-sectional side view of the droplet discharge head of the image forming apparatus according to a second example.

FIG. 9 is a cross-sectional side view of the droplet discharge head 434 of the image forming apparatus according to the second example. Unlike the image forming apparatus according to the first example, for the droplet discharge head 434 in the second example, no intermediate plate is interposed between the first plate 2 and the second plate 3. Instead of the intermediate plate, the large cross-section portion 14*a* and the small cross-section portion 14*b* of the circulation channel 14 have the following configurations. For example, a half-etched portion (recessed portion) as a portion of the large cross-section portion 14*a* is disposed at a first face (lower face) of the second plate 3. Of the entire range of the circulation channel 14 in the longitudinal direction, an overlap region of the half-etched portion of the second plate 3 and the slit of the first plate 2 acts as the large cross-section portion 14*a*. Another overlap region of the slit of the first plate 2 and a portion other than the half-etched portion and the slit of the second plate 3, which is shallower than the large cross-section portion 14*a*, acts as the small cross-section portion 14*b*.

Such a configuration allows the large cross-section portion 14*a* and the small cross-section portion 14*b* of the circulation channel 14 to be provided without the intermediate plate. Accordingly, the number of components and processing steps can be reduced, thus allowing cost reduction. The channel resistance of the small cross-section portion 14*b* can be adjusted by not only the length of the small cross-section portion 14*b* but also the depth of the small cross-section portion 14*b*, thus increasing the degree of freedom of design.

Third Example

Figure 10:
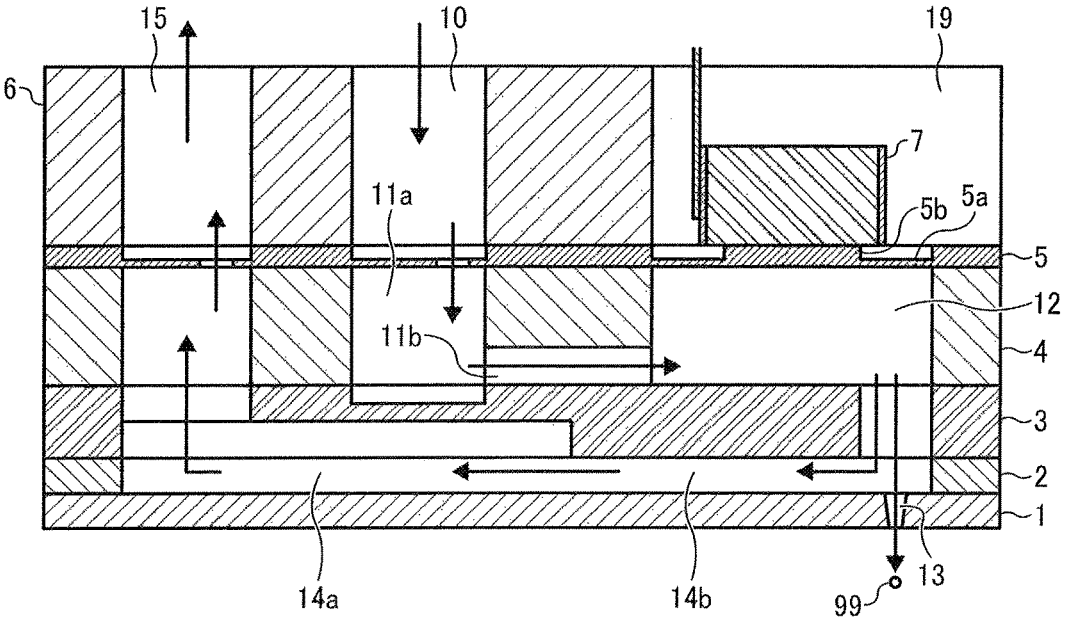
FIG. 10 is a cross-sectional side view of the droplet discharge head of the image forming apparatus according to a third example.
Figure 11:
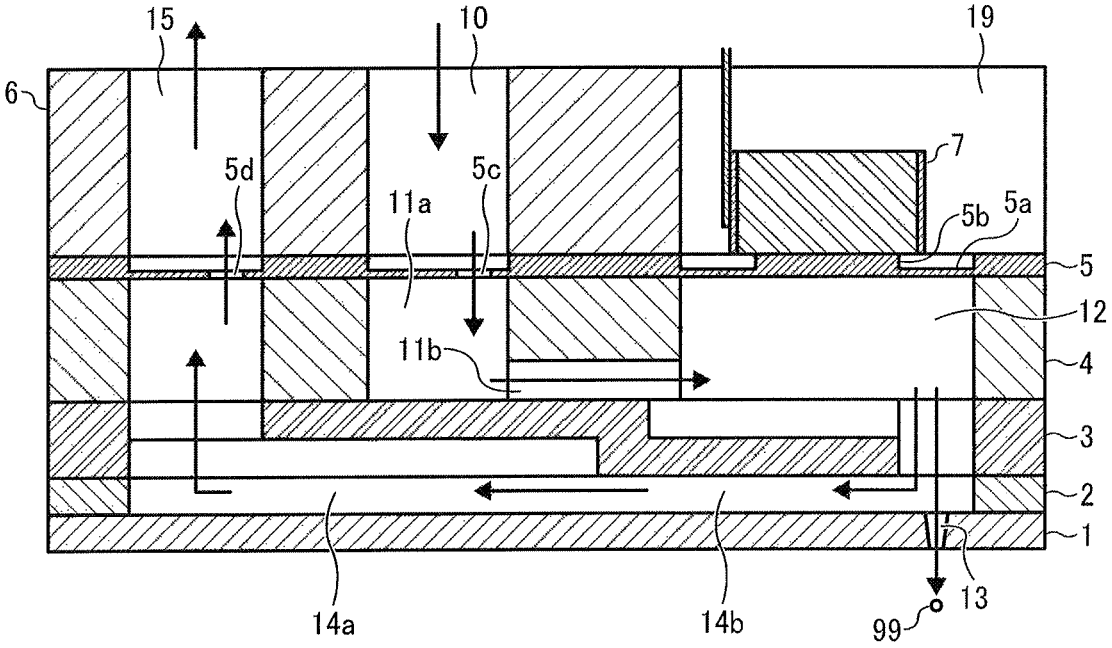
FIG. 11 is a cross-sectional side view of the droplet discharge head of the image forming apparatus according to a fourth example.

The image forming apparatus according to a third example has the same configuration as the image forming apparatus according to the second example except the following difference. FIG. 10 is a cross-sectional side view of the droplet discharge head 434 of the image forming apparatus according to the third example. In FIG. 10, similarly with the second example, a plurality of half-etched portions to form the large cross-section portions 14*a* of the plurality of circulation channels 14 is formed at a first face of the second plate 3. Unlike the second example, a plurality of half-etched portions to from the large cross-section portions 11*a* of the plurality of supply channels 11 is formed at a second face (upper face) of the second plate 3.

For the image forming apparatus according to the third example, similarly with the second example, the slit of the first plate 2 and the half-etched portion of the first face of the second plate 3 are overlapped with each other to form the large cross-section portion 14*a* of each of the plurality of circulation channels 14. Unlike the second example, for the third example, the third plate 4 has a plurality of half-etched portions to form the small cross-section portions 11*b* of the plurality of supply channels 11 and a plurality of slits to form the large cross-section portions 11*a* of the plurality of supply channels 11. A portion other than the half-etched portion and the slit of the second face of the second plate 3 is overlapped with the half-etched portion of the third plate 4 to form the small cross-section portion 11*b* of each of the plurality of supply channels 11. The half-etched portion of the second face of the second plate 3 is overlapped with the slit of the third plate 4 to form the large cross-section portion 11*a* of each of the plurality of the supply channels 11.

With such a configuration, adjusting the depth of the half-etched portion of the second face of the second plate 3 allows easy adjustment of the volume of the large cross-section portion 11*a* of the supply channel 11. When the droplet discharge head 434 is separately manufactured corresponding to different machine types differing in the specification of the viscosity of ink, plates other than the second plate 3 can be shared among the different machine types. For example, to discharge different types of ink having different viscosities, the volume of the large cross-section portion 11*a* of the supply channel 11 and the volume of the large cross-section portion 14*a* of the circulation channel 14 might be required to differ from each other. Even in such a case, other plates can be shared among different machine types, except that the depth of the half-etched portion of the first face or the half-etched portion of the second face of the second plate 3 is different among different machine types.

Fourth Example

The image forming apparatus according to a fourth example has the same configuration as the image forming apparatus according to the second example except the following difference. FIG. 10 is a cross-sectional side view of the droplet discharge head 434 of the image forming apparatus according to the fourth example. For the droplet discharge head 434 according to the fourth example, a plurality of half-etched portions (recessed portions) as part of the plurality of pressure generation chambers 12 is disposed at the second face (upper face) of the second plate 3. An overlap region of the slit of the third plate 4 and the half-etched portion of the second face of the second plate 3 acts as the pressure generation chamber 12.

With such a configuration, adjusting the depth of the half-etched portion of the second face of the second plate 3 allows easy adjustment of the volume of the large cross-section portion 11*a* of the supply channel 11. When the droplet discharge head 434 is separately manufactured corresponding to different machine types differing in the specification of the viscosity of ink, plates other than the second plate 3 can be shared among the different machine types. For example, to discharge different types of ink having different viscosities, the volume of the pressure generation chamber 12 and the volume of the large cross-section portion 14*a* of the circulation channel 14 might be required to differ from each other. Even in such a case, other plates can be shared among different machine types, except that the depth of the half-etched portion of the first face or the half-etched portion of the second face of the second plate 3 is different among different machine types.

For the fourth example, a convex portion adjacent to the half-etched portion of the second face of the second plate 3 is used as a bottom face of the small cross-section portion 11*b* of the supply channel 11. With such a configuration, adjusting the length of the half-etched portion allows easy adjustment of the length of the small cross-section portion 11*b* of the supply channel 11 and the channel resistance of the small cross-section portion 11*b*.

Figure 12:
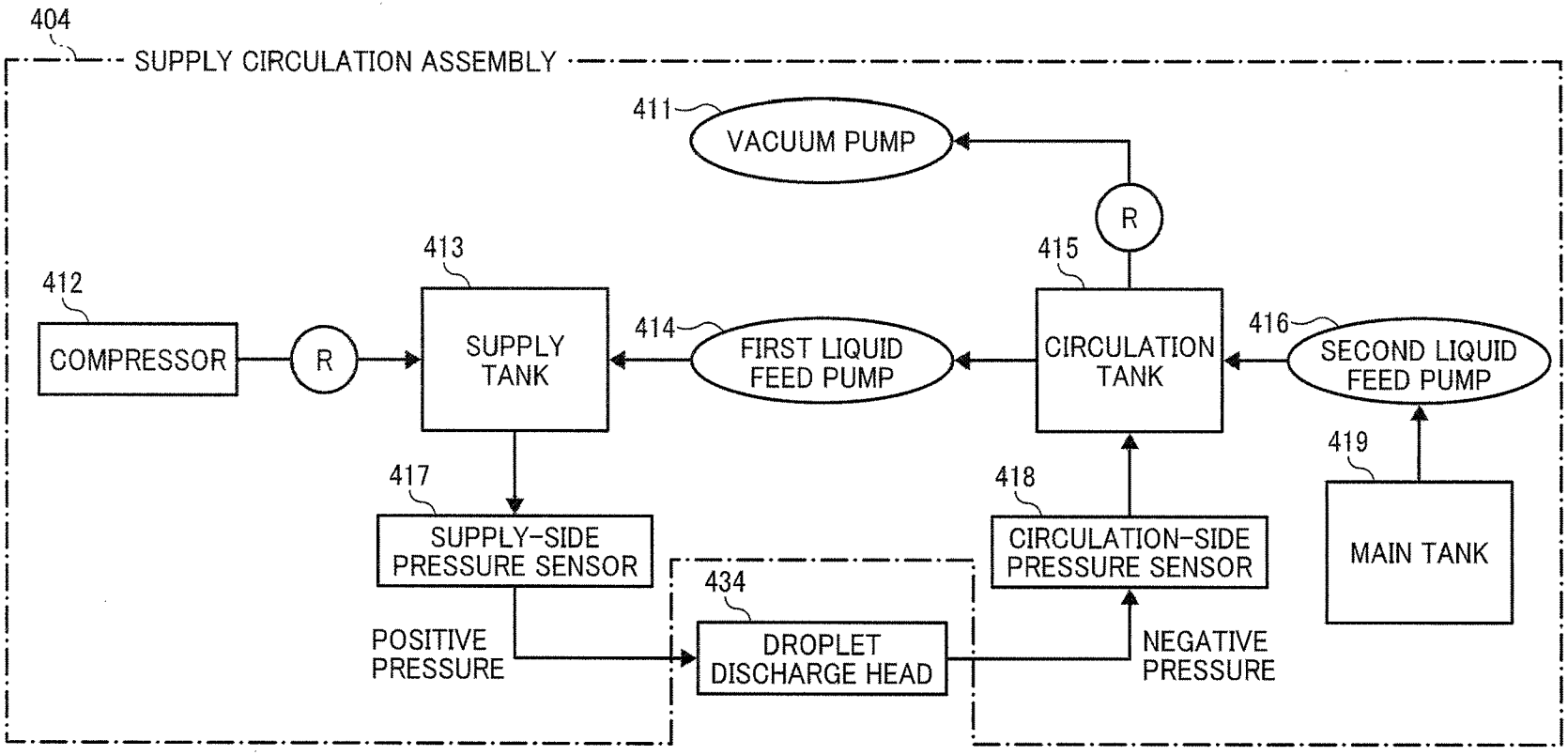
FIG. 12 is a block diagram of a configuration of a supply circulation assembly with the droplet discharge head according to an embodiment of the present disclosure.

The image forming apparatus according to any of the above-described embodiment and examples employs an ink circulation system in which ink is circulated by driving of a pump. In some embodiments, another ink circulation system may be employed in which ink is circulated by the pressurizing force of the laminated piezoelectric element 7. The ink circulation system employed in the image forming apparatus according to any of the above-described embodiment and examples is described below. FIG. 12 is a block diagram of a configuration of the supply circulation assembly 404 with the droplet discharge head 434. As illustrated in FIG. 12, the supply circulation assembly 404 includes, e.g., a main tank 419, the supply tank 413, the circulation tank 415, a compressor 412, a vacuum pump 411, the first liquid feed pump 414, and a second liquid feed pump 416, a regulator R, the supply-side pressure sensor 417, and the circulation-side pressure sensor 418.

The supply-side pressure sensor 417 is disposed between the supply tank 413 and the droplet discharge head 434 and connected to a supply channel side connected to the supply tubes 16 (see FIG. 6) of the droplet discharge head 434. The circulation-side pressure sensor 418 is disposed between the circulation tank 415 and the droplet discharge head 434 and connected to a circulation channel side connected to the circulation tubes 17 (see FIG. 6) of the droplet discharge head 434.

One end of the circulation tank 415 is connected to the supply tank 413 via the first liquid feed pump 414 and the other end of the circulation tank 415 is connected to the main tank 419 via the second liquid feed pump 416. Accordingly, liquid flows from the supply tank 413 into the droplet discharge head 434 via the supply tubes 16, is delivered from the circulation tubes 17 into the circulation tank 415, and fed from the circulation tank 415 to the supply tank 413 by the first liquid feed pump 414, thus allowing circulation of liquid.

The supply tank 413 is connected to the compressor 412 and controlled so that a predetermined positive pressure is detected with the supply-side pressure sensor 417. The circulation tank 415 is connected to the vacuum pump 411 and controlled so that a predetermined negative pressure is detected with the circulation-side pressure sensor 418. Such a configuration allows the menisci of ink to be maintained at a constant negative pressure while circulating ink through the inside of the droplet discharge head 434.

When droplets are discharged from the nozzles 13 of the droplet discharge head 434, the amount of ink in the supply tank 413 and the circulation tank 415 decreases. Accordingly, liquid is replenished from the main tank 419 to the circulation tank 415 with the second liquid feed pump 416. The timing of replenishment of liquid from the main tank 419 to the circulation tank 415 is controlled in accordance with a result of detection with, e.g., a liquid level sensor in the circulation tank 415, for example, in a manner in which liquid is replenished when the liquid level of liquid in the circulation tank 415 is lower than a predetermined height.

Note that the circulation of liquid can be performed not only during operation of the droplet discharge head 434 but also during the suspension of operation. Circulation during the suspension of operation can reduce aggregation and sedimentation of components of liquid while constantly refreshing liquid in the pressure generation chambers 12.

The above-described embodiments and examples are limited examples, and the present disclosure includes, for example, the following aspects having advantageous effects.

Aspect A

According to Aspect A, a droplet discharge head (for example, the droplet discharge head 434) includes a plurality of discharge orifices (for example, the nozzles 13) to discharge droplets; a plurality of pressure generation chambers (for example, the pressure generation chambers 12) separately communicated with the plurality of discharge orifices, to apply pressure to liquid in the plurality of pressure generation chambers; a supply liquid chamber (for example, the supply liquid chamber 10) to store liquid to be supplied to the plurality of pressure generation chambers; a plurality of supply channels (for example, the supply channels 11) communicated with the plurality of pressure generation chambers; a circulation liquid chamber (for example, the circulation liquid chamber 15) to receive liquid collected from the plurality of pressure generation chambers; and a plurality of circulation channels (for example, the circulation channels 14) communicating the plurality of pressure generation chambers with the circulation liquid chamber. Each of the plurality of circulation channels includes a small cross-section portion (for example, the small cross-section portion 14*b*) that has a smaller cross-sectional area in a width direction perpendicular to a longitudinal direction of each of the plurality of circulation channels than another portion in the longitudinal direction of each of the plurality of circulation channels.

With such a configuration, the small cross-section portion of the circulation channel applies resistance against liquid entering from the pressure generation chamber to the circulation channel and restricts the amount of liquid collected from the pressure generation chamber into the circulation liquid chamber via the circulation channel. Such a configuration can reduce the shortage of the discharge amount of droplets discharged from the nozzle orifices due to the collection of liquid from the pressure generation chamber into the circulation liquid chamber.

Aspect B

According to Aspect B, in Aspect A, a first plate (for example, the first plate 2) is overlapped with a second plate (for example, the second plate 3). The first plate includes a plurality of slits or recessed portions to form the small cross-section portion and a large cross-section portion (for example, the large cross-section portion 14*a*) of each of the plurality of circulation channels. The large cross-section portion has a larger cross-sectional area in the width direction than the small cross-section portion. The second plate includes a plurality of slits or recessed portions to form the large cross-section portion. The large cross-section portion includes a first overlap region of the plurality of slits or recessed portions of the first plate and the plurality of slits or recessed portions of the second plate. The small cross-section portion includes a second overlap region of the plurality of slits or recessed portions of the first plate and a portion other than the plurality of slits or recessed portions in the second plate. With such a configuration, without setting the width of the small cross-section portion to be smaller than the width of the large cross-section portion, the depth of the small cross-section portion is set to be smaller than the depth of the large cross-section portion, so that the small cross-section portion has a smaller cross-sectional area in the width direction than the large cross-section portion. Thus, as a method of making a hole in the first plate to form the small cross-section portion, a reasonable processing method not requiring high level of dimensional accuracy or low level of shock can be employed, thus allowing cost reduction. By adjusting the thickness of the first plate, the channel resistance of the small cross-section portion can be easily adjusted, thus allowing easy adjustment of the ratio of the channel resistance of the large cross-section portion and the small cross-section portion.

Aspect C

According to Aspect C, in Aspect B, the second plate includes the plurality of slits and the second overlap region in which the plurality of slits or recessed portions of the first plate overlaps with the portion other than the plurality of recessed portions in the second plate acts as the small cross-section portion. With such a configuration, the volume of the large cross-section portion of circulation channel can be easily adjusted by adjusting the depth of the recessed portion of the second plate.

Aspect D

According to Aspect D, in Aspect C, each of the plurality of supply channels has a small cross-section portion that has a smaller cross-sectional area in a width direction perpendicular to a longitudinal direction of each of the plurality of supply channels than another portion in the longitudinal direction of each of the plurality of supply channels. With such a configuration, the ratio of the channel resistance of the flow of liquid returning from the pressure generation chamber to the supply channel side and the channel resistance of the flow of liquid moving from the pressure generation chamber to the circulation channel side can be easily adjusted by adjusting the length or depth of the small cross-section portion of each of the plurality of supply channels.

Aspect E

According to Aspect E, in Aspect D, the droplet discharge head includes a third plate (for example, the third plate 4) including a plurality of slits or recessed portions to form the small cross-section portion and a large cross-section portion of each of the plurality of supply channels that has a larger cross-sectional area in the width direction of each of the plurality of supply channels than the small cross-section portion of each of the plurality of supply channels. The second plate includes a first face including a plurality of first recessed portions to form the large cross-section portion (for example, the large cross-section portion 14*a*) of each of the plurality of circulation channels (for example, the supply channel 11); and a second face including a plurality of second recessed portions to form the large cross-section portion of each of the plurality of supply channels. The first plate is overlapped with the first face of the second plate to form the plurality of supply channels. The large cross-section portion of each of the plurality of supply channels includes an overlap region of the plurality of slits or recessed portions of the third plate and the plurality of second recessed portions of the second face of the second plate. The small cross-section portion of each of the plurality of supply channels includes an overlap region of the plurality of slits or recessed portions of the third plate and a portion other than the plurality of second recessed portions of the second face of the second plate. With such a configuration, adjusting the depth of the recessed portion of the second face of the second plate allows easy adjustment of the volume of the large cross-section portion of the supply channel.

Aspect F

According to Aspect F, in Aspect C, the second plate includes a first face including a plurality of first recessed portions to form the large cross-section portion of each of the plurality of circulation channels; and a second face including a plurality of second recessed portions to form the plurality of pressure generation chambers. With such a configuration, adjusting the depth of the recessed portion of the second face of the second plate allows easy adjustment of the volume of the pressure generation chamber.

Aspect G

According to Aspect G, an image forming apparatus (for example, the image forming apparatus 1000) includes the droplet discharge head according to any of Aspects A to F to discharge droplets from the plurality of discharge orifice to record an image on a recording sheet, a sheet conveyor to convey the recording sheet in a first direction, and a carriage mounted with the droplet discharge head, to move the droplet discharge head along a surface of the recording sheet in a second direction perpendicular to the first direction.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A droplet discharge head comprising:

a plurality of discharge orifices to discharge droplets;

a plurality of pressure generation chambers communicated with the plurality of discharge orifices, to apply pressure to liquid in the plurality of pressure generation chambers;

a supply liquid chamber to store liquid to be supplied to the plurality of pressure generation chambers;

a plurality of supply channels communicated with the plurality of pressure generation chambers;

a circulation liquid chamber to receive liquid collected from the plurality of pressure generation chambers; and a plurality of circulation channels communicating the plurality of pressure generation chambers with the circulation liquid chamber, each of the plurality of circulation channels including a small cross-section portion that has a smaller cross-sectional area in a width direction perpendicular to a longitudinal direction of each of the plurality of circulation channels than another portion in the longitudinal direction of each of the plurality of circulation channels;

a first plate including a plurality of slits or recessed portions to form the small cross-section portion and a large cross-section portion of each of the plurality of circulation channels, the large cross-section portion in the width direction of each of the plurality of circulation channels having a larger cross-sectional area than the small cross-section portion; and a second plate including a plurality of slits or recessed portions to form the large cross-section portion, the second plate overlapped with the first plate, wherein the large cross-section portion includes a first overlap region of the plurality of slits or recessed portions of the first plate and the plurality of slits or recessed portions of the second plate, and wherein the small cross-section portion includes a second overlap region of the plurality of slits or recessed portions of the first plate and a portion other than the plurality of slits or recessed portions in the second plate.

2. The droplet discharge head according to claim 1, wherein the second plate includes the plurality of slits, and wherein, in the second overlap region, the plurality of slits or recessed portions of the first plate overlaps with the portion other than the plurality of recessed portions in the second plate.

3. The droplet discharge head according to claim 2, wherein each of the plurality of supply channels has a small cross-section portion that has a smaller cross-sectional area in a width direction perpendicular to a longitudinal direction of each of the plurality of supply channels than another portion in the longitudinal direction of each of the plurality of supply channels.

4. The droplet discharge head according to claim 3, further comprising:

a third plate including a plurality of slits or recessed portions to form the small cross-section portion and a large cross-section portion of each of the plurality of supply channels that has a larger cross-sectional area in the width direction of each of the plurality of supply channels than the small cross-section portion of each of the plurality of supply channels, wherein the second plate includes:

a first face including a plurality of first recessed portions to form the large cross-section portion of each of the plurality of circulation channels; and a second face including a plurality of second recessed portions to form the large cross-section portion of each of the plurality of supply channels, the first plate overlapped with the first face of the second plate to form the plurality of supply channels, wherein the large cross-section portion of each of the plurality of supply channels includes an overlap region of the plurality of slits or recessed portions of the third plate and the plurality of second recessed portions of the second face of the second plate, and wherein the small cross-section portion of each of the plurality of supply channels includes an overlap region of the plurality of slits or recessed portions of the third plate and a portion other than the plurality of second recessed portions of the second face of the second plate.

5. The droplet discharge head according to claim 2, wherein the second plate includes:

a first face including a plurality of first recessed portions to form the large cross-section portion of each of the plurality of circulation channels; and a second face including a plurality of second recessed portions to form the plurality of pressure generation chambers.

6. An image forming apparatus comprising:

the droplet discharge head according to claim 1 to discharge droplets from the plurality of discharge orifice to record an image on a recording sheet;

a sheet conveyor to convey the recording sheet in a first direction; and a carriage mounted with the droplet discharge head, to move the droplet discharge head along a surface of the recording sheet in a second direction perpendicular to the first direction.

* * * * *